US006488178B1

(12) United States Patent
Chun

(10) Patent No.: US 6,488,178 B1
(45) Date of Patent: Dec. 3, 2002

(54) DETACHABLE SHUTTING DEVICE FOR A PLASTIC CONTAINER

(76) Inventor: Sung-Soo Chun, 106-1501 Keukdong Apt., San 17, Sadang-Dong, Dongjak-ku, Seoul (KR)

( * ) Notice: Subject to any disclaimer, the term of this patent is extended or adjusted under 35 U.S.C. 154(b) by 0 days.

(21) Appl. No.: 09/622,103

(22) PCT Filed: Feb. 18, 1999

(86) PCT No.: PCT/KR99/00079

§ 371 (c)(1),
(2), (4) Date: Aug. 10, 2000

(87) PCT Pub. No.: WO99/42380

PCT Pub. Date: Aug. 26, 1999

(51) Int. Cl.[7] ..... B65D 35/44
(52) U.S. Cl. ..... 222/105; 222/568; 222/92; 222/107
(58) Field of Search ..... 222/92, 105, 107, 222/568

(56) References Cited

U.S. PATENT DOCUMENTS 3,474,788 A * 10/1969 Corbin et al. ..... 604/262
3,589,362 A * 6/1971 Zamarra ..... 604/212
4,405,321 A * 9/1983 Budoff ..... 604/212
4,678,092 A * 7/1987 Rane ..... 215/11.3
5,709,478 A * 1/1998 Chen ..... 215/11.3 X
5,871,119 A * 2/1999 Blackinton, Jr. ..... 222/107 X

FOREIGN PATENT DOCUMENTS

FR 2 517 634 A * 6/1983

* cited by examiner

*Primary Examiner*—Kenneth Bomberg
(74) *Attorney, Agent, or Firm*—Blakely, Sokoloff Taylor & Zafman LLP

(57) ABSTRACT

A first thread of an external screw member is received inside an outlet of the plastic container. The external screw member has a first cylindrical body with a first axial penetrating opening for dispensing contents of the container by passing through the opening. The external screw member is engaged with the internal screw member. The outlet of the plastic container is caught between the external screw member and internal screw member. To easily insert the plastic container, a lower part of the first thread of the external screw member has a larger diameter than an upper part. The second penetrating opening of the internal screw member is opened or closed by opening or closing the covering member. Therefore, the contents of the container can be easily and cleanly dispensed by opening the covering member and then by pouring out the contents. Thereafter the container can be stored with the covering member shut tightly.

12 Claims, 8 Drawing Sheets

DETACHABLE SHUTTING DEVICE FOR A PLASTIC CONTAINER

TECHNICAL FIELD

The present invention relates to a detachable shutting device for a plastic container to easily dispense the contents therein.

BACKGROUND ART

Generally, a plastic container may be used to pack powdered materials such as sugar, salt, and coffee, and also may be used to pack liquid material such as cleaning materials and shampoo for re-filling so as to economize by using the original container of the liquid materials.

The user cuts the edge of the plastic container to dispense contents, e.g., cleanser or shampoo. When contents remain in the container after being dispensed, the container may be kept by folding the cut edge.

FIG. 1 is a schematic perspective view for showing a plastic container 20 of which an edge 22 is cut.

Conventionally, when the user dispenses the contents after cutting the edge 22 of the plastic container 20, it is difficult to appropriately dispense the desired amount of the contents. Moreover, the cut outlet of the container 20 is stained with the contents after dispensing, and it is a troublesome work to clean the stained outlet.

Furthermore, when the user dispenses the liquid content such as shampoo, rinse, or cleanser from the plastic container 20 for refilling into the original shampoo or rinse container 20, it is difficult to position the outlet of the plastic container 20 for refilling to the entrance of the original container 20. Therefore, it is difficult to keep the container 20 clean.

Moreover, when some contents have been left in the container 20 after being dispensed, the container 20 needs to be properly stored as its cut outlet is folded, and trouble may occur due to spilling of the contents.

DISCLOSURE OF INVENTION

The present invention is intended to overcome the above-mentioned and numerous other disadvantages and deficiencies of the prior art. Therefore, it is an object of the present invention to provide a detachable shutting device for a plastic container according to the present invention which comprises an external screw member for being received inside the cut outlet of the plastic container. The external screw member has a first cylindrical body with a first axial penetrating opening for dispensing the contents from the container by passing through the opening, and a first thread formed on an external surface of the first cylindrical body.

The detachable shutting device has an internal screw member for being engaged with the external screw member as the outlet portion of the plastic container is caught between the external screw member and internal screw member. The internal screw member has a second cylindrical body with a second axial penetrating opening for inserting the external screw member therein. The internal screw member is provided with a second thread formed on the internal surface of the second cylindrical body so that the internal screw member can be engaged with the external screw member.

The detachable shutting device has a covering member connected at an upper part of the internal screw member for opening or closing the second penetrating opening of the internal screw member by opening or closing the covering member.

According to the detachable shutting device of the prevent invention, the cut section of the plastic container an be sealed by the external screw member and the internal screw member. The external screw member has the axial penetrating opening, and the covering member to open or close is formed on the upper part of the penetrating opening. Therefore, the contents in the container can be easily and cleanly dispensed by opening the covering member and then by pouring the contents. Thereafter, the container can be stored with the covering member shut tightly.

BRIEF DESCRIPTION OF DRAWINGS

The present invention may be better understood and its numerous objects and advantages will be more apparent to those skilled in the art by reference to the accompanying drawings in which.

BEST MODE FOR CARRYING OUT THE INVENTION

Hereinafter, the preferred embodiments of this invention will be described in detail with reference to the accompanying drawings.

Embodiment 1

Figure 1:
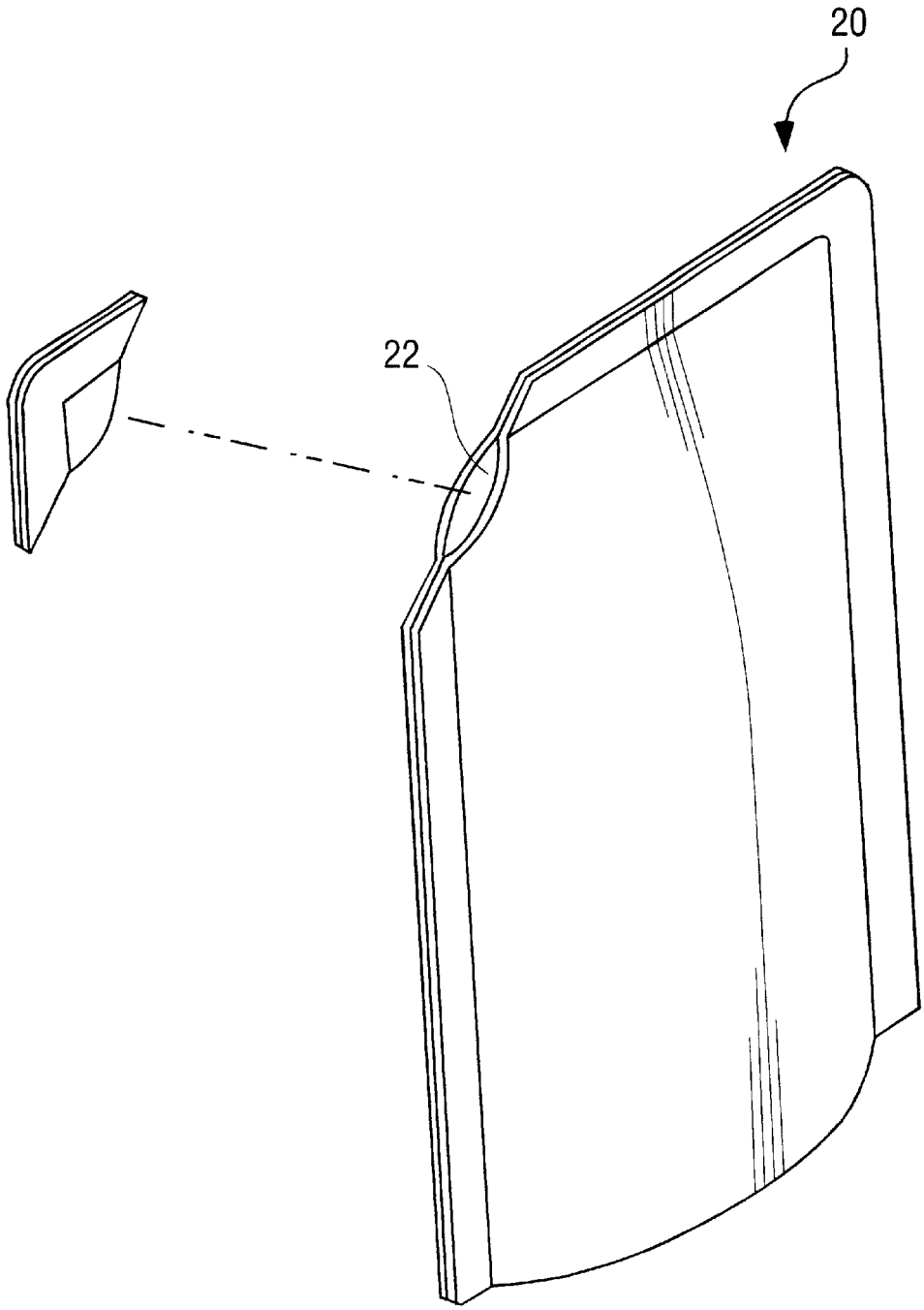
FIG. 1 (PRIOR ART)
FIG. 1 is a perspective view for showing a cut conventional plastic container.
Figure 2:
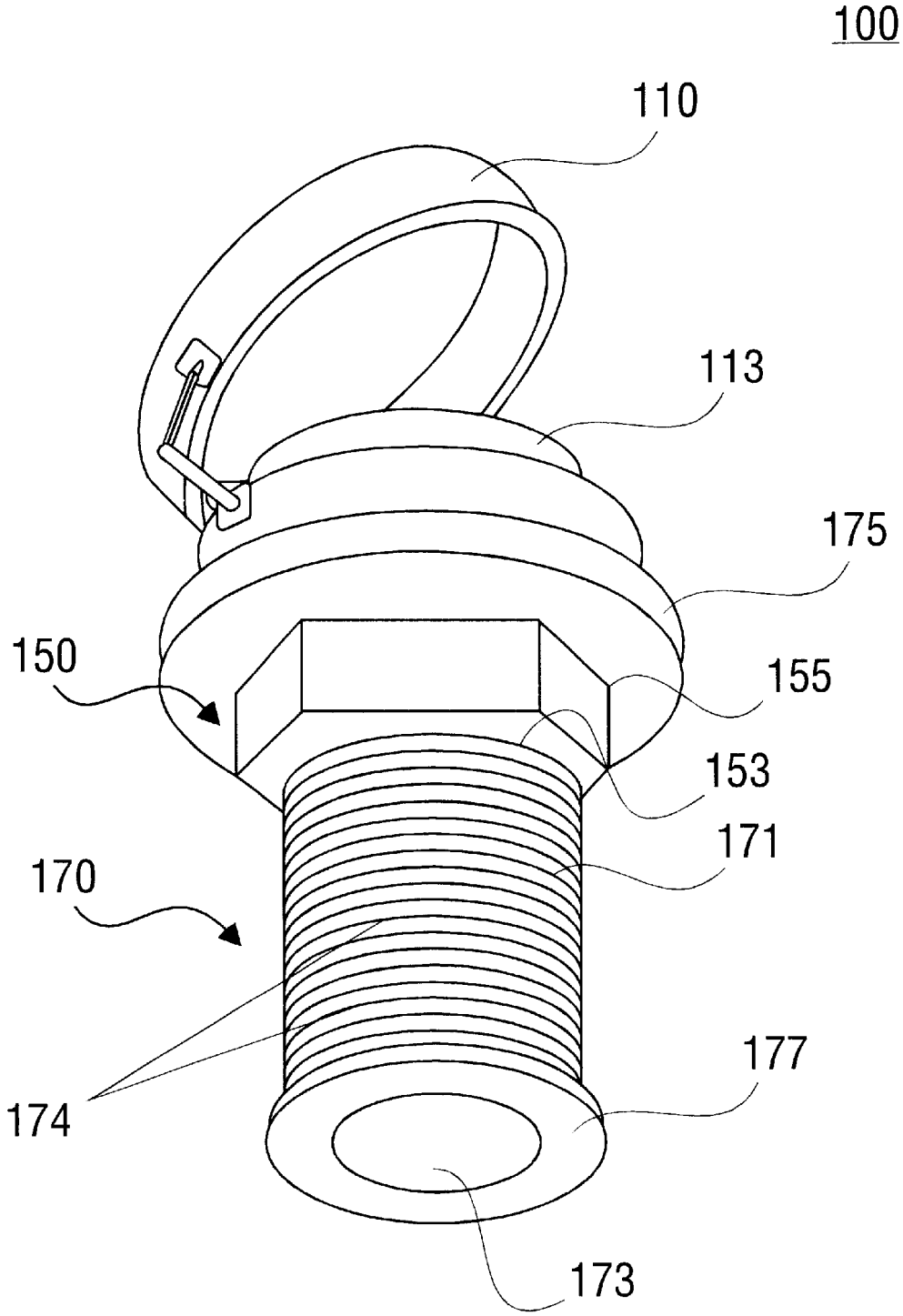
FIG. 2 is a perspective view for showing a detachable shutting device for a plastic container according to a first embodiment of the present invention.
Figure 3A:
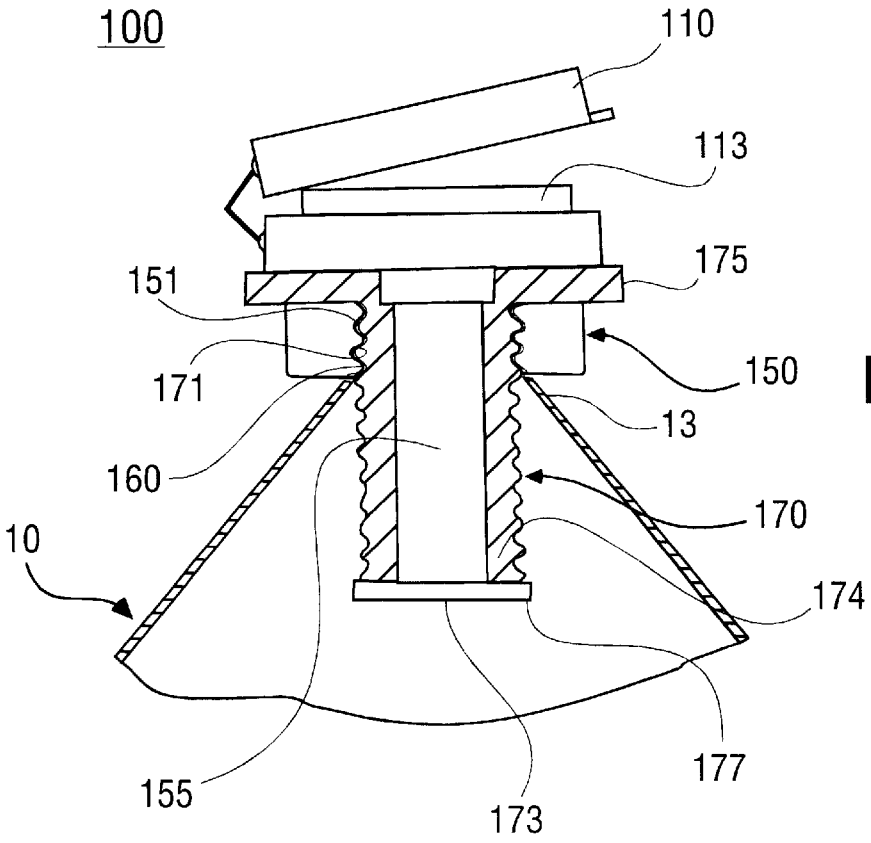
FIG. 3A is a cross-sectional view for showing a state before the shutting device of FIG. 2 is securely attached to the plastic container.

FIG. 2 is a perspective view for showing a detachable shutting device for a plastic container according to a first embodiment of the present invention. FIG. 3A is a cross-sectional view for showing a state before the shutting device of FIG. 2 is attached to the plastic container, and FIG. 3B is a cross-sectional view for showing a state after the shutting device of FIG. 2 is attached to the plastic container.

Figure 3B:
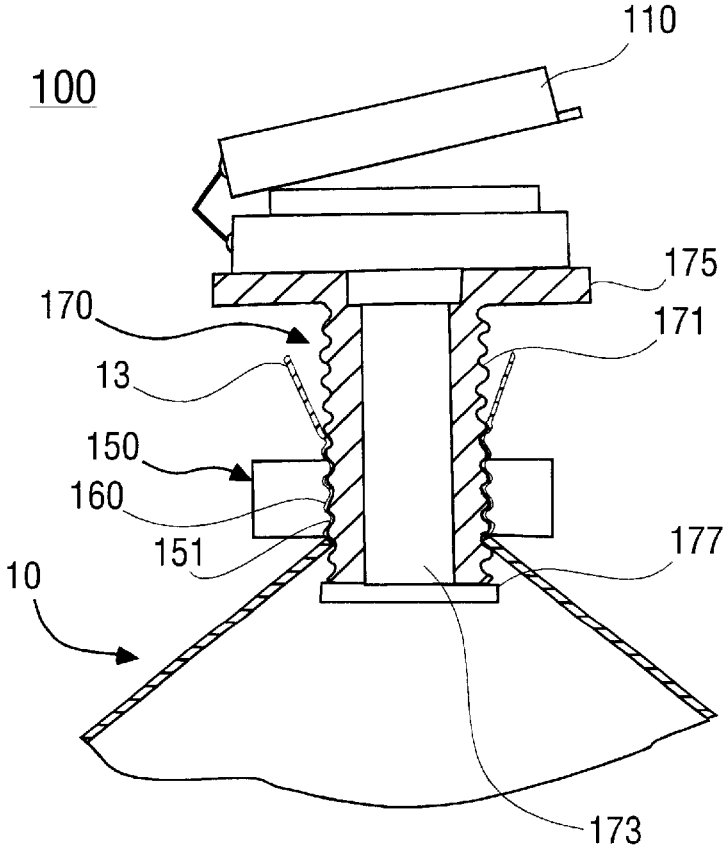
FIG. 3B is a cross-sectional view for showing a state after the shutting device of FIG. 2 is securely attached to the plastic container.

As shown in FIGS. 2, 3A, and 3B, the detachable shutting device 100 for a plastic container 10 according to a first embodiment of the present invention has an external screw member 170 for being received inside a cut outlet portion 13 of the plastic container 10. The external screw member 170 has a first cylindrical body 174 with a first axial penetrating opening 173 for dispensing the contents from the container 10 by passing through the opening 173, and a first thread 171 formed on an external surface of the first cylindrical body 174.

The detachable shutting device 100 has an internal screw member 150 which is engaged with the external screw member 170 as the outlet portion 13 of the plastic container 10 is caught between the external screw member 170 and the internal screw member 150. The internal screw member 150 has a second cylindrical body 155 with a second axial penetrating opening 153 for inserting the external screw member 170 therein. The internal screw member 150 is provided with a second thread 151 formed on the internal surface of the second cylindrical body 154 so that the internal screw member 150 is engaged with the external screw member 170 by engagement of the first thread 171 and the second thread 151.

The detachable shutting device 100 has a covering member 110 connected at an upper part of the internal screw member 150. By opening or closing the covering member 110, the second penetrating opening 153 of the internal screw member 150 is opened or closed.

The external screw member 170 preferably has an upper sealing ring part 175 integrally formed at the upper part of the first thread 171. The upper sealing ring part 175 prevents the internal screw member 150 from being separated from the external screw member 170. The upper sealing ring part 175 prevents the internal screw member 150 from being separated from the external screw member 170.

Furthermore, the external screw member 170 preferably has a lower sealing ring part 177 integrally formed at the lower part of the first thread 171. The lower sealing ring part 177 serves to closely adhere the internal screw member 150 to the external screw member 170, which increases the sealing effect of the plastic container 10.

Hereinafter, the process in which the above-mentioned detachable shutting device 100 is attached to the plastic container 10 will be described.

First, the plastic container 10, in which the content is held, is cut.

The internal screw member 150, e.g., a tightening nut, is placed at the top of the first thread 171. The lower part of the external screw member 170, i.e., the first thread 171, is inserted into the cut outlet portion 13 of the plastic container 10. The cut outlet portion 13 of the plastic container 10 is clenched to be put close to the first thread 171, and then the upper part of the outlet portion 13 of the plastic container 10 is inserted into a joining space 160 between the first thread 171 of the external screw member 170 and the second thread 151 of the tightening nut 150.

After that, as shown in FIG. 3B, the tightening nut 150 is screwed down. The cut outlet portion 13 of the plastic container 10 inserted into the joining space 160 between the external screw member 170 and the tightening nut 150 is closely adhered to the external screw member 170 by the tightening nut 150. Thereby, the detachable shutting device 100 is affiixed at the plastic container 10.

The method for using the plastic container 10 mounting the shutting device 100 is described as follows.

The user opens the covering member 110 to dispense the contents, e.g., shampoo or rinse, through the outlet portion 13 into the original shampoo or rinse container. Thereafter, the user keeps the plastic container 10 sealed by closing the covering member 110.

When the user wants to throw away the plastic container 10 after all the contents of the container 10 are used, the user may unscrew the tightening nut 150 upwardly. Then, the the plastic container 10 is separated from the external screw member 170. The separated shutting device 100 can be applied to another plastic container 10.

Embodiment 2

Figure 4:
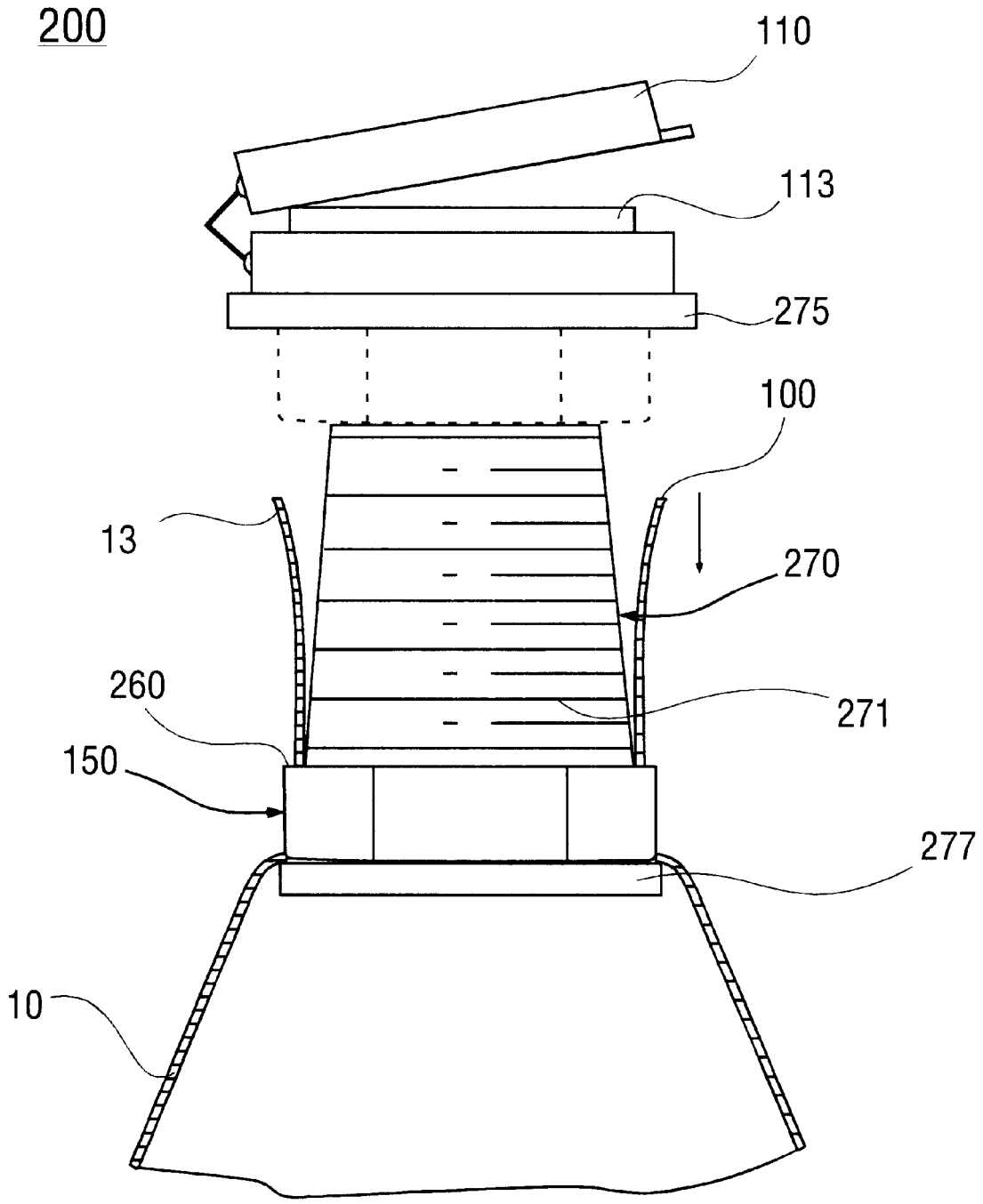
FIG. 4 is a cross-sectional view for showing a detachable shutting device according to a second embodiment of the present invention which is attached to the plastic container.

FIG. 4 is a cross-sectional view for showing a detachable shutting device according to a second embodiment of the present invention which is attached to the plastic container.

A detachable shutting device 200 shown in this embodiment is a modified example of the detachable shutting device 100 of the first embodiment. As shown in FIG. 4, the same reference numeral as in FIGS. 2, 3A and 3B denotes the same constitutional element as in the detachable shutting device 100 of the first embodiment. The descriptions for the same constitutional elements will be abbreviated.

As shown in FIG. 4, the detachable shutting device 200 shown in this embodiment is the same as the detachable shutting device 100 of the first embodiment except for a shape of an external screw member 270 with a first thread 271. That is, the external screw member 270 has the first thread 271 in which the lower part of the first thread 271 has the larger diameter.

Accordingly, the diameter of the second thread 151 inside the tightening nut 150 is set to correspond with that of the bottom part of the first thread 271.

The external screw member 270 preferably has an upper sealing ring part 275 integrally formed at the upper part of the first thread 271. The upper sealing ring part 275 prevents the internal screw member 150 from being separated from the external screw member 270.

Furthermore, the external screw member 270 preferably has a lower sealing ring part 277 integrally formed at the lower part of the first thread 271. The lower sealing ring part 277 serves to closely adhere the internal screw member 150 to the external screw member 270, which increases the sealing effect of the plastic container 10.

Hereinafter, the process in which the above-mentioned detachable shutting device 200 is attached to the plastic container 10 will be described.

The internal screw member 150, e.g., a tightening nut, is placed at the bottom of the first thread 271 of the external screw member 270.

To place the shutting device 200 close to the plastic container 10, the tightening nut 150 is rotated to the top part of the first thread 271. Because the diameter of the lower part of the first thread 271 is larger than that of the upper part, the joining space 260 is larger in the upper part of the first thread 271.

The first thread part 271 of the external screw member 270 is inserted into the cut outlet portion 13 of the plastic container 10.

The cut outlet portion 13 of the plastic container 10 is clenched to be put close to the first thread 271, and then the upper part of the outlet portion 13 of the plastic container 10 is inserted into the joining space 260 between the first thread 271 of the external screw member 270 and the second thread 151 of the tightening nut 150.

After that, the tightening nut 150 is screwed down. The cut outlet portion 13 of the plastic container 10 inserted into the joining space 260 between the external screw member 270 and the tightening nut 150 is closely adhered to the external screw member 270 by the tightening nut 150.

Thereby, the detachable shutting device 200 is affixed within the plastic container 10.

The method for using the plastic container 10 having the shutting device 200 is the same as in the first embodiment.

When the user wants to throw away the plastic container 10 after all the contents of the container 10 are used, the user may unscrew the tightening nut 150 upwardly. Then, the the plastic container 10 is separated from the external screw member 270. The separated shutting device 200 can be also applied to another plastic container 10.

Embodiment 3

Figure 5:
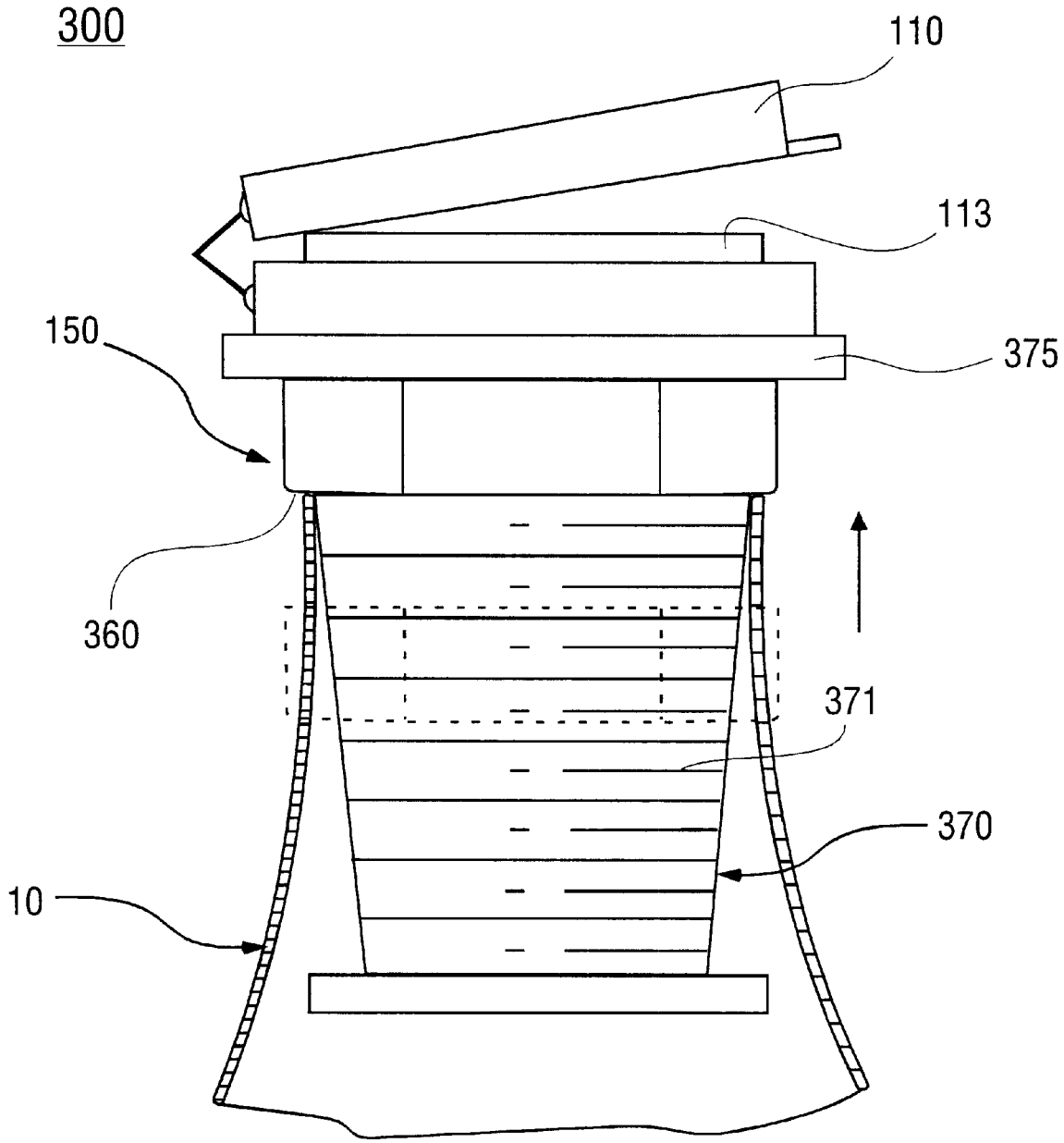
FIG. 5 is a cross-sectional view for showing a detachable shutting device according to a third embodiment of the present invention which is attached to the plastic container.

FIG. 5 is a cross-sectional view for showing a detachable shutting device according to a third embodiment of the present invention which is attached to the plastic container.

A detachable shutting device 300 shown in this embodiment is another modified example of the detachable shutting device 100 of the first embodiment. As shown in FIG. 5, the same reference numeral as in FIGS. 2, 3A and 3B denotes the same constitutional element as in the detachable shutting device 100 of the first embodiment. The descriptions for the same constitutional elements will be abbreviated.

As shown in FIG. 5, the detachable shutting device 300 shown in this embodiment is the same as the detachable shutting device 100 of the first embodiment except for a shape of an external screw member 370 with a first thread 371. That is, the external screw member 370 has the first thread 371 in which the lower part of the first thread 371 has the smaller diameter.

Accordingly, the diameter of the second thread 151 inside the tightening nut 150 is set to correspond with that of the top part of the first thread 371.

Furthermore, the external screw member 370 preferably has an upper sealing ring part 375 integrally formed at the upper part of the first thread 371. The upper sealing ring part 375 serves to closely adhere the internal screw member 150 to the external screw member 370, which increases the sealing effect of the plastic container 10.

Hereinafter, the process in which the above-mentioned detachable shutting device 300 is attached to the plastic container 10 will be described.

The internal screw member 150, e.g., a tightening nut, is placed at the top of the first thread 371 of the external screw member 370.

To place the shutting device 300 close to the plastic container 10, the lower part of the external screw member 370, i.e., the first thread 371, is inserted into the cut outlet portion 13 of the plastic container 10.

The cut outlet portion 13 of the plastic container 10 is clenched to be put close to the first thread 371, and then the tightening nut 150 is screwed down to the bottom part of the first thread 371. Because the diameter of the lower part of the first thread 371 is smaller than that of the upper part, the joining space 360 is larger in the lower part of the first thread 371. Therefore, when the tightening nut 150 has been screwed down, the cut outlet portion 13 of the plastic container 10 is inserted with ease into the larger joining space 360 in the lower part of the first thread 371.

Thus, when the upper part of the outlet portion 13 of the plastic container 10 has been inserted into the joining space 360 formed by the external screw member 370 and the tightening nut 150, the cut outlet portion 13 of the plastic container 10 is pulled up over the top part of the first thread 371.

After that, the tightening nut 150 is screwed upwardly. Because the diameter of the upper part of the first thread 371 is larger than that of the lower part, the cut outlet portion 13 of the plastic container 10 inserted into the joining space 360 between the external screw member 370, and the tightening nut 150 can be closely adhered to the upper part of the external screw member 370 by the tightening nut 150.

Thereby, the detachable shutting device 300 is affixed within the plastic container 10.

The method for using the plastic container 10 mounting the shutting device 300 is the same as in the first embodiment.

When the user wants to throw away the plastic container 10 after all the contents of the container 10 are used, the user may screw the tightening nut 150 downwardly. Then, the the plastic container 10 is separated from the external screw member 370. The separated shutting device 300 can be also applied to another plastic container.

Embodiment 4

Figure 6:
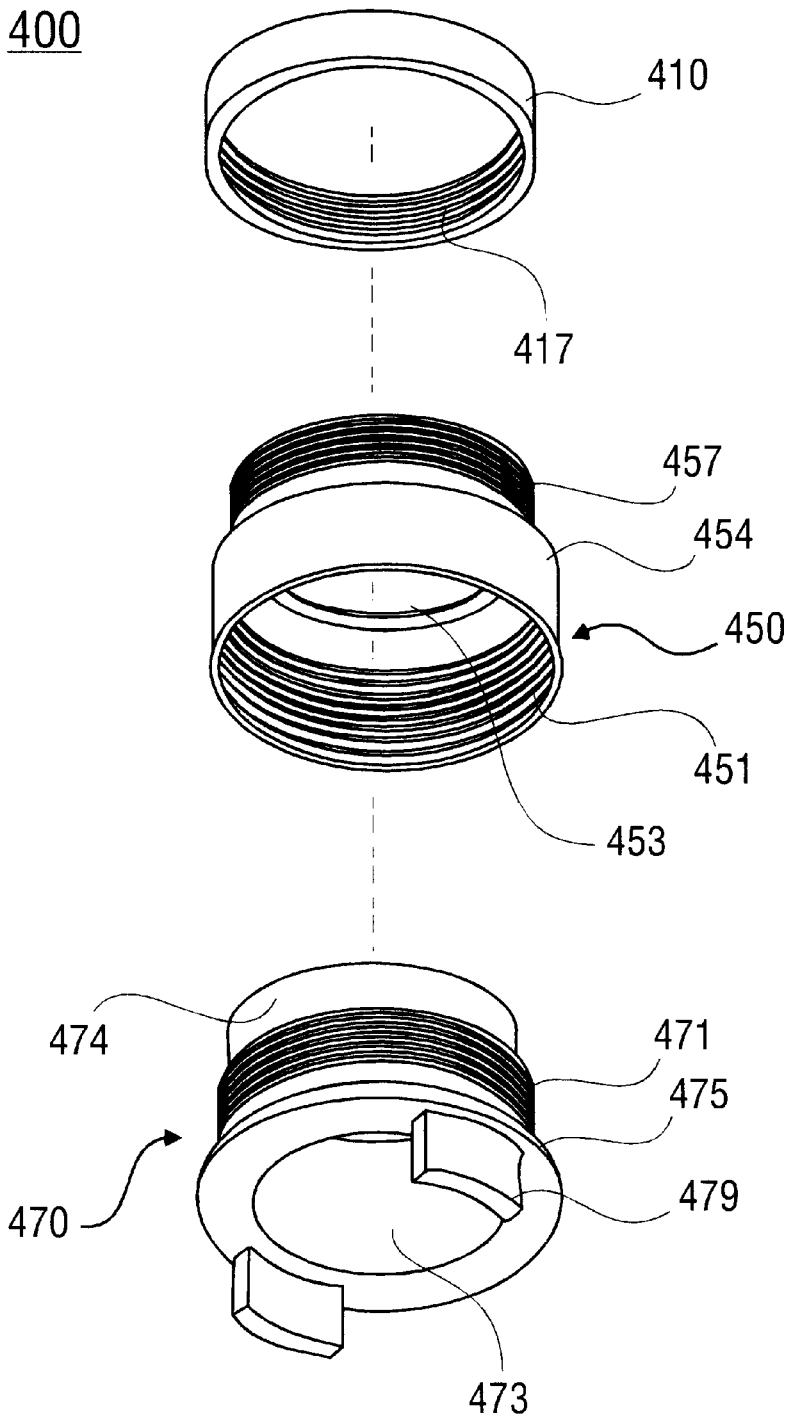
FIG. 6 is an exploded perspective view for showing a detachable shutting device according to a fourth embodiment of the present invention.
Figure 7A:
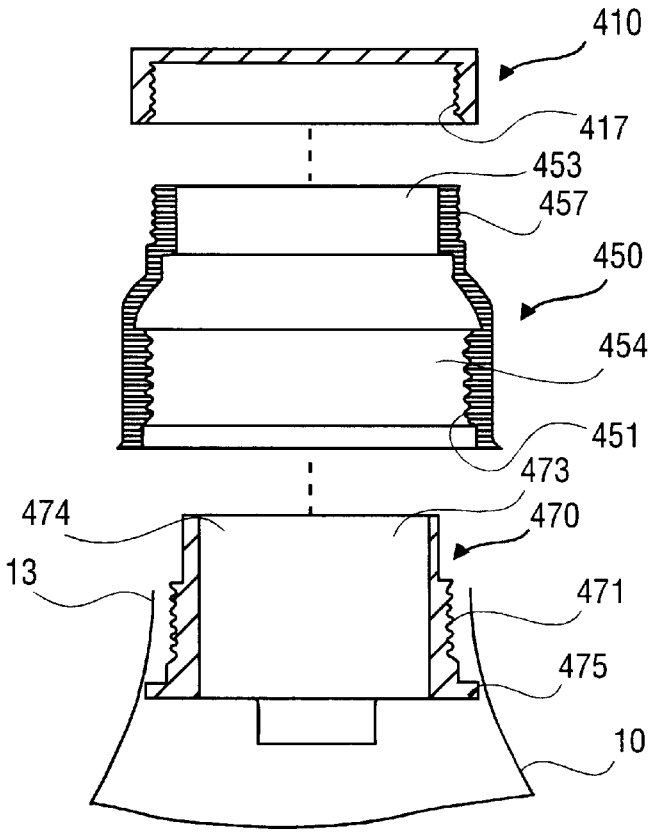
FIG. 7A is a cross-sectional view for showing a state before the shutting device of FIG. 6 is attached to the plastic container.

FIG. 6 is a perspective view for showing a detachable shutting device for a plastic container according to a fourth embodiment of the present invention. FIG. 7A is a cross-sectional view for showing a state before the shutting device of FIG. 2 is attached to the plastic container, and FIG. 7B is a cross-sectional view for showing a state after the shutting device of FIG. 2 is attached to the plastic container.

Figure 7B:
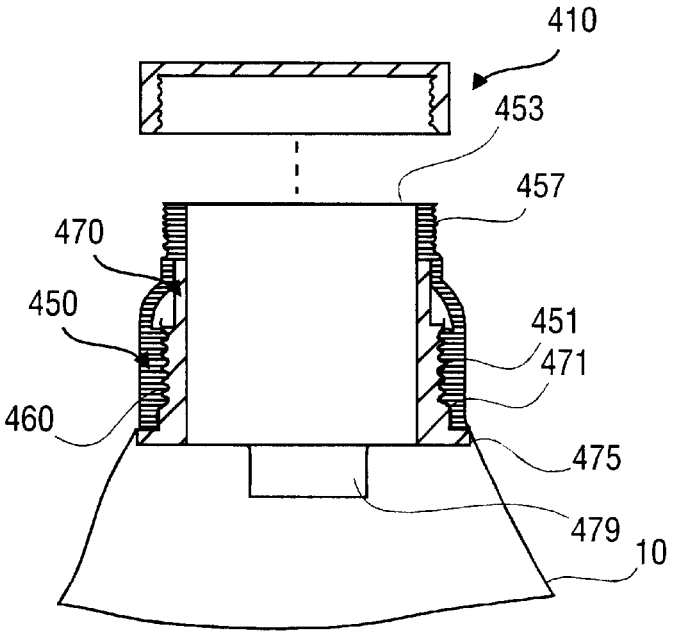
FIG. 7B is a cross-sectional view for showing a state after the shutting device of FIG. 6 is attached to the plastic container.

As shown in FIGS. 6, 7A and 7B, a detachable shutting device 400 for a plastic container 10 according to a fourth embodiment of the present invention has an external screw member 470 for being received inside a cut outlet portion 13 of the plastic container 10. The external screw member 470 has a first cylindrical body 474 with a first axial penetrating opening 473 for dispensing the contents in the container 10 by passing through the opening 473, and a first thread 471 formed on an external surface of the first cylindrical body 474.

The detachable shutting device 400 has an internal screw member 450 for being engaged with the external screw member 470 as the outlet portion 13 of the plastic container 10 is caught between the external screw member 470 and the internal screw member 450. The internal screw member 450 has a second cylindrical body 455 with a second axial penetrating opening 453 for inserting the external screw member 470 therein. The internal screw member 450 is provided with a second thread 451 formed on the internal surface of the second cylindrical body 454 so that the internal screw member 450 is engaged with the external screw member 470 by engagement of the first thread 471 and the second thread 451.

The internal screw member 450 is provided with a third thread 457 formed on the external surface of the second cylindrical body 454.

The external screw member 470 preferably has a lower sealing ring part 475 integrally formed at the lower part of the first thread 471. The lower sealing ring part 475 serves to closely adhere the internal screw member 450 to the external screw member 470, which increases the sealing effect of the plastic container 10.

The external screw member 470 is provided with a grasping part 479 extended from the lower sealing ring part 475. Thus, after the user inserts the external screw member 470 into the plastic container 10, he grasps the grasping part 479 of the external screw member 470 from outside of the plastic container 10. Thereby, when the internal screw member 450 is mounted at the external screw member 470 as the cut portion of the plastic container 10 is inserted therebetween, the external screw member 470 and the plastic container 10 can be easily affixed by the user.

The detachable shutting device 400 has a covering member 410 to be installed at an upper part of the internal screw member 450. The covering member 410 is provided with a fourth thread 417 formed on the internal surface of the lower part thereof. The fourth thread 417 of the covering member 410 is to be engaged with the third thread 457 formed on the external surface of the second cylindrical body 454. By opening or closing the covering member 410, the plastic container 10 is communicated with the outside or sealed against the outside.

Hereinafter, the process that the above-mentioned detachable shutting device 400 is attached to the plastic container 10 will be described.

First, the plastic container 10, in which the content is held, is cut.

As shown in FIGS. 7A and 7B, the lower part of the external screw member 470, i.e., the first thread 471, is inserted into the cut outlet portion 13 of the plastic container 10. The cut outlet portion 13 of the plastic container 10 is clenched to be put close to the first thread 471, and then the upper part of the outlet portion 13 of the plastic container 10 is inserted into a joining space 460 between the first thread 471 of the external screw member 470 and the second thread 451 of the tightening nut 450.

After that, as shown in FIG. 7B, the tightening nut 450 is screwed down. The cut outlet portion 13 of the plastic container 10 inserted into the join space 460 between the external screw member 470 and the tightening nut 450 is closely adhered to the external screw member 470 by the tightening nut 450. Thereby, the detachable shutting device 400 is mounted at the plastic container 10.

The method for using the plastic container 10 having the shutting device 400 is described as follows.

The user opens the covering member 410 to dispense the contents, e.g., shampoo or rinse, through the outlet portion 13 into the original shampoo or rinse container. Thereafter, the user keeps the plastic container 10 sealed by closing the covering member 410.

When the user wants to throw away the plastic container 10 after all the contents of the container 10 are used, the user may screw the tightening nut 450 upwardly. Then, the the plastic container 10 is separated from the external screw member 470. The separated shutting device 400 can be applied to another plastic container 10.

Embodiment 5

Figure 8A:
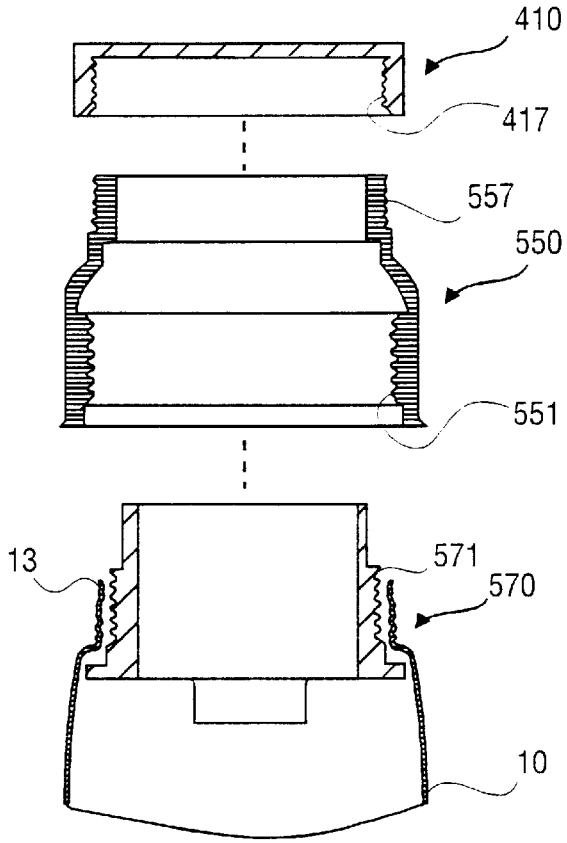
FIG. 8A is a cross-sectional view for showing a state before a detachable shutting device according to a fifth embodiment of the present invention is attached to the plastic container.

FIG. 8A is a cross-sectional view for showing a detachable shutting device according to a fifth embodiment of the present invention which is attached to the plastic container.

Figure 8B:
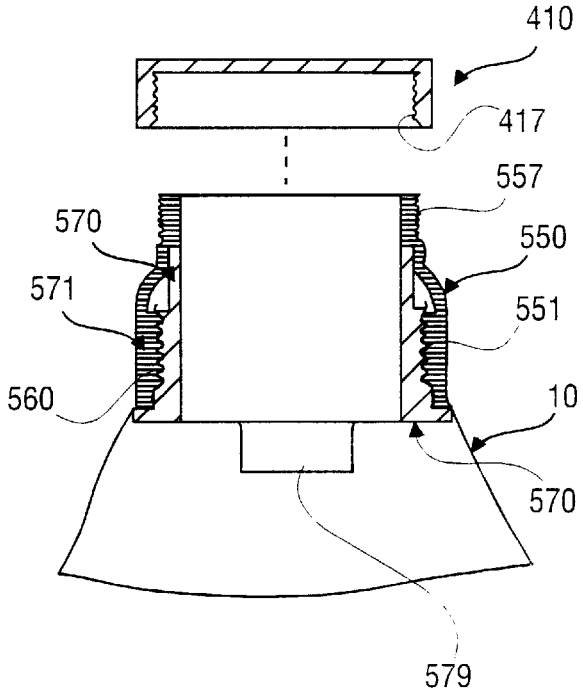
FIG. 8B is a cross-sectional view for showing a state after the detachable shutting device according to a fifth embodiment of the present invention is attached to the plastic container.

A detachable shutting device 500 shown in this embodiment is a modified example of the detachable shutting device 400 of the fifth embodiment. As shown in FIGS. 8A and 8B, the same reference numerals as in FIGS. 2, 3A and 3B denote the same constitutional elements as in the detachable shutting device 400 of the fifth embodiment. The descriptions for the same constitutional elements will be abbreviated.

As shown in FIGS. 8A and 8B, the detachable shutting device 500 shown in this embodiment is the same as the detachable shutting device 400 of the fifth embodiment except for a shape of an external screw member 570 with a first thread 571 and a shape of an internal screw member 550 with a second thread 551. That is, the external screw member 570 has the first thread 571 in which the lower part of the first thread 571 has the larger diameter, and the internal screw member 550 has the second thread 551 in which the lower part of the second thread 551 has the larger diameter. The fourth thread 417 of the covering member 410 still engages with a third thread 557 formed on the external surface of the internal screw member 550. Hereinafter, the process in which the above-mentioned detachable shutting device 500 is attached to the plastic container 10 will be described.

As shown in FIGS. 8A and 8B, the lower part of the external screw member 570, i.e., the first thread 571, is inserted into the cut outlet portion 13 of the plastic container 10. After the external screw member 570 is inserted into the plastic container 10, the user places the cut part of the plastic container 10 close to the first thread 571 while grasping the grasping part 579 of the external screw member 570 from outside of the plastic container 10.

A top part of the cut outlet portion 13 of the plastic container 10 is easily inserted into the second thread 551 of the internal screw member 550.

The reason is because the diameter of the lower part of the first thread 571 is larger than that of the upper part and the diameter of the lower part of the second thread 551 is larger than that of the upper part; therefore, the diameter of the top part of the first thread 571 is smaller than that of the bottom part of the second thread 551.

After that, the internal screw member 550 is screwed down. The cut outlet portion 13 of the plastic container 10 inserted into the join space 560 between the external screw member 570 and the internal screw member 550 is sealed between the external screw member 570 and the internal screw member 550.

Thereby, the detachable shutting device 500 is affixed within the plastic container 10.

The method for using the plastic container 10 having the shutting device 500 is the same as in the fifth embodiment.

When the user wants to throw away the plastic container 10 after the contents of the container 10 are used up, the user may unscrew the internal screw member 550 to separate it from the external screw member 570. Then, the plastic container 10 may be separated from the external screw member 570. The separated shutting device 500 can be also applied to another plastic container.

According to the detachable shutting devices of the prevent invention, the cut part of the plastic container can be sealed tightly between the external screw member and the internal screw member. The external screw member has the axial penetrating hole, and the covering member for opening or closing is formed on the upper part of the penetrating hole. Therefore, the contents in the container can be easily and cleanly dispensed by opening the covering member and then by pouring out the contents. Thereafter, the container can be stored with the covering member shut tightly.

Furthermore, according to the detachable shutting devices of the prevent invention, the plastic container 10 can be easily separated from the shutting device by unscrewing the screwed engagement between the external screw member and the internal screw member. Therefore, it also becomes possible to apply only one shutting device to a plurality of plastic containers.

It is understood that various other modifications will be apparent to and can be readily made by those skilled in the art without departing from the scope and spirit of this invention. Accordingly, it is not intended that the scope of the claims appended thereto be limited to the description as set forth herein, but rather that the claims be constructed as encompassing all the features of patentable novelty that reside in the present invention, including all features that would be treated as equivalents thereof by those skilled in the art to which this invention pertains.

What is claimed is:

1. A detachable device for sealing and dispensing contents of a plastic container, comprising:

an external screw member receivable inside a cut section forming an outlet of the plastic container, the external screw member having a first cylindrical body with a first axial penetrating opening for dispensing the contents of the plastic container through the opening, and a first thread formed on an external surface of the first cylindrical body;

an internal screw member which is engaged with the external screw member when the outlet of the plastic container is caught between the external screw member and the internal screw member, the internal screw member having a second cylindrical body with a second axial penetrating opening for inserting the external screw member therein, the internal screw member being provided with a second thread formed on an internal surface of the second cylindrical body so that the internal screw member can be engaged with the external screw member; wherein a lower part of the first thread of the external screw member has a larger diameter than an upper part of the first thread; and a covering member connected at an upper portion of the internal screw member to open or close the second penetrating opening of the internal screw member by opening or closing the covering member.

2. The detachable shutting device as claimed in claim 1, wherein the external screw member has a lower sealing ring part formed at a lower part of the first thread so that the lower sealing ring part serves to closely adhere the internal screw member to the external screw member, which is capable of increasing a sealing effect of the plastic container.

3. The detachable shutting device as claimed in claim 1, wherein the external screw member has an upper sealing ring part formed at an upper part of the first thread so that the upper sealing ring part prevents the internal screw member from being separated from the external screw member.

4. A detachable shutting device for sealing and dispensing contents of a plastic container, comprising:

an external screw member receivable inside a cut section forming an outlet of the plastic container, the external screw member having a first cylindrical body with a first axial penetrating opening for dispensing the contents of the plastic container through the opening, and a first thread formed on an external surface of the first cylindrical body;

an internal screw member which is engaged with the external screw member when the outlet of the plastic container is caught between the external screw member and the internal screw member, the internal screw member having a second cylindrical body with a second axial penetrating opening for inserting the external screw member therein, the internal screw member being provided with a second thread formed on an internal surface of the second cylindrical body so that the internal screw member can be engaged with the external screw member, and a diameter at a lower part of the second thread of the internal screw member corresponds with that of a lower part of the first thread of the external screw member, and a lower part of the second thread has a larger diameter than an upper part of the second thread; wherein a joining space formed between the external screw member and the internal screw member is larger at an upper part of the first thread; and a covering member connected to an upper portion of the internal screw member to open or close the second penetrating opening of the internal screw member by opening or closing the covering member.

5. The detachable shutting device as claimed in claim 4, wherein the external screw member has a lower sealing ring part formed at a lower part of the first thread so that the lower sealing ring part serves to closely adhere the internal screw member to the eternal screw member, which is capable of increasing a sealing effect of the plastic container.

6. The detachable shutting device as claimed in claim 5, wherein the external screw member is provided with a grasping part extended from the lower sealing ring part for easily mounting the internal screw member to the external screw member.

7. The detachable shutting device as claimed in claim 4, wherein the external screw member has an upper sealing ring part formed at an upper part of the first thread so that the upper sealing ring part prevents the internal screw member from being separated from the external screw member.

8. A detachable shutting device for sealing and dispensing contents of a plastic container, comprising:

an external screw member receivable inside a cut section forming an outlet of the plastic container, the external screw member having a first cylindrical body with a first axial penetrating opening for dispensing the contents of the plastic container through the opening, and a first thread formed on an external surface of the first cylindrical body;

an internal screw member which is engaged with the external screw member when the outlet portion of the plastic container is caught between the external screw member and the internal screw member, the internal screw member having a second cylindrical body with a second axial penetrating opening for inserting the external screw member therein, the internal screw member being provided with a second thread formed on an internal surface of the second cylindrical body so that the internal screw member can be engaged with the external screw member, wherein lower parts of the first thread of the external screw member and the second thread of the internal screw member have larger diameters than upper parts of the first thread and the second thread, respectively, and the internal screw member having a third thread formed on an external surface of the second cylindrical body; and a covering member located at an upper part of the internal screw member to open or close the second penetrating opening of the internal screw member by opening or closing the covering member, the covering member being provided with a fourth thread formed on a lower internal surface of the covering member so that the fourth thread of the covering member can be engaged with the third thread of the internal screw member.

9. The detachable shutting device as claimed in claim 8, wherein the external screw member has a lower sealing ring part formed at a lower part of the first thread so that the lower sealing ring part serve to closely adhere the internal screw member to the external screw member, which increases a sealing effect of the plastic container.

10. The detachable shutting device as claimed in claim 9 wherein the external screw member is provided with a grasping part extended from the lower sealing ring part for easily mounting the internal screw member at the external screw member.

11. A detachable shutting device for sealing and dispensing contents of a plastic container, comprising:

an external screw member receivable inside a cut section forming an outlet of the plastic container, the external screw member having a first cylindrical body with a first axial penetrating opening for dispensing the contents of the plastic container through the opening, and a first thread formed on an external surface of the first cylindrical body;

an internal screw member which is engaged with the external screw member when the outlet portion of the plastic container is caught between the external screw member and internal screw member, the internal screw member having a second cylindrical body with a second axial penetrating opening for inserting the external screw member therein, the internal screw member being provided with a second thread formed on an internal surface of the second cylindrical body so that the internal screw member can be engaged with the external screw member, and the internal screw member having a third thread formed on an external surface of the second cylindrical body;

a covering member located at an upper part of the internal screw member to open or close the second penetrating opening of the internal screw member by opening or closing the covering member, the covering member being provided with a fourth thread formed on a lower internal surface of the covering member so that the fourth thread of the covering member can be engaged with the third thread of the internal screw member; and a grasping part extended from a lower sealing ring part of the external screw member for easily mounting the internal screw member at the external screw member.

12. A detachable shutting device for sealing and dispensing contents of a plastic container, comprising:

an external screw member which is receivable inside a cut section forming an outlet of the plastic container, the external screw member having a first cylindrical body with a first axial penetrating opening for dispensing the contents of the plastic container by passing through the opening, and a first thread formed on an external surface of the first cylindrical body;

an internal screw member which is engaged with the external screw member when the outlet of the plastic container is caught between the external screw member and internal screw member, the internal screw member having a second cylindrical body with a second axial penetrating opening for inserting the external screw member therein, the internal screw member being provided with a second thread formed on an internal surface of the second cylindrical body so that the internal screw member can be engaged with the external screw member, and wherein a lower part of the first thread of the external screw member has a larger diameter than an upper part of the first thread;

a covering member connected at an upper portion of the internal screw member to open or close the second penetrating opening of the internal screw member by opening or closing the covering member; and a grasping part extended from a lower sealing ring part of the external screw member for easily mounting the internal screw member to the external screw member.

* * * * *